US008027499B2

(12) United States Patent
Wearing

(10) Patent No.: US 8,027,499 B2
(45) Date of Patent: Sep. 27, 2011

(54) PORTABLE AUDIO SYSTEM WITH CHANGEABLE FUNCTIONALITY

(76) Inventor: John A. Wearing, Durham, NC (US)

( * ) Notice: Subject to any disclaimer, the term of this patent is extended or adjusted under 35 U.S.C. 154(b) by 2040 days.

(21) Appl. No.: 10/846,026

(22) Filed: May 14, 2004

(65) Prior Publication Data

US 2005/0254678 A1 Nov. 17, 2005

(51) Int. Cl.
*H04R 9/06* (2006.01)
*H04R 1/02* (2006.01)

(52) U.S. Cl. ..... 381/334; 381/335; 381/386

(58) Field of Classification Search ..... 381/334–335, 381/386; 369/6–12; 439/638, 680; 455/344, 455/345, 3.06

See application file for complete search history.

(56) References Cited

U.S. PATENT DOCUMENTS

| | | | | |
|---|---|---|---|---|
| 2,539,146 | A | 1/1951 | Loewy | |
| 2,866,891 | A | 12/1958 | Princ | |
| 3,103,630 | A | 9/1963 | Pitts et al. | |
| 3,134,945 | A | 5/1964 | Wertheimer | |
| 4,501,013 | A | 2/1985 | Sato | |
| 4,807,292 | A | 2/1989 | Sorscher | |
| 4,829,500 | A | 5/1989 | Sanders | |
| 4,870,702 | A | 9/1989 | Azzouni | |
| 5,390,246 | A | 2/1995 | Gay et al. | |
| 5,732,140 | A * | 3/1998 | Thayer | 381/300 |
| 5,864,627 | A | 1/1999 | Kim | |
| 5,921,664 | A * | 7/1999 | Lee | 362/296.09 |
| 6,721,430 | B2 * | 4/2004 | Wang | 381/334 |
| 6,950,525 | B2 * | 9/2005 | Harrell et al. | 381/59 |
| 6,975,737 | B2 * | 12/2005 | Hirao | 381/302 |
| 7,095,867 | B2 | 8/2006 | Schul et al. | |
| 7,346,332 | B2 * | 3/2008 | McCarty et al. | 455/402 |
| 2005/0244025 | A1 * | 11/2005 | Schul et al. | 381/334 |

FOREIGN PATENT DOCUMENTS

KR 2001-0105139 * 11/2001

* cited by examiner

*Primary Examiner* — Devona Faulk
*Assistant Examiner* — George Monikang
(74) *Attorney, Agent, or Firm* — Coats & Bennett, P.L.L.C.

(57) ABSTRACT

A portable audio system includes a housing, battery, wiring harness, speakers, and two or more audio controllers, each including at least one audio functionality different from at least one other. The functionality of the portable audio system may be reconfigured as desired by removing one audio controller and installing a different audio controller. A quick-detach connector on the wiring harness facilitates the swapping of audio controllers, which are preferably automotive audio controllers. The portable audio system includes external power and speaker connectors, with the internal power and speakers being switchably disconnectable. Thus, the portable audio system may also be used as a fixed, or home, audio system.

18 Claims, 7 Drawing Sheets

PORTABLE AUDIO SYSTEM WITH CHANGEABLE FUNCTIONALITY

BACKGROUND

The present invention relates generally to portable audio systems, and in particular to a portable audio system, capable of serving as the console for a fixed audio system, wherein the audio functionality may be changed by substituting audio controllers.

A wide variety of audio systems—both fixed and portable—are known in the art. These systems reproduce audio content from a variety of sources, such as phonographic records, magnetic tape (e.g., reel-to-reel, 8-track, cassette), optical digital storage media (e.g., audio CD, MP3 CD, DVD), broadcast audio programs (e.g., AM, FM, satellite), and the like. Typically, an audio system will provide the functionality of reproducing audio content from two or more such sources. For example, one audio system may include an AM/FM tuner and a CD player. Another audio system may include a CD player and cassette tape deck, with no broadcast tuner functionality.

With fixed or "home" audio systems, designed to be moved only infrequently, a popular approach to providing a combination of audio system functions is to package such functionality into separate components. Such a system may comprise at its core an amplifier, which may include an AM/FM tuner, with external speaker outputs and certain user controls. A user may then add, for example, a second component including one or more cassette tape decks. A third component may comprise a CD player or multi-CD player, and so on. This allows each user to assemble the precise combination of audio features desired, without incurring the cost of audio system functionality that the user does not desire and would not utilize.

Portable audio system manufacturers, on the other hand, have traditionally eschewed the component approach to providing disparate functionality. Portable audio systems typically come with a fixed combination of functions (e.g., an AM/FM tuner, CD player, and single cassette deck). Users are often forced to select a "best fit" combination of system functionality, and have no way to later add functionality or otherwise change the assembled audio functionality on an ad hoc basis.

Additionally, many users do not wish to incur the expense of separate fixed and portable audio systems. While portable audio systems with the capability of driving a fixed system (e.g., with external speaker connectors and the like) are known, such systems are typically based on the portable audio system model. That is, they provide only a pre-determined, fixed combination of audio system functionality, with no means to add or change that functionality as required or desired by the user.

SUMMARY

The present invention relates to a portable audio system. The audio system includes a portable housing containing a battery connected to a wiring harness. A first controller having a first audio/video functionality is removably mounted in said housing. A second controller including at least one audio/video function not included in the first controller is removably mountable in the housing. A connector is attached to the wiring harness and is operative to connect to either the first or second controller, whereby the audio system functionality may be altered by mounting either the first or second controller in the housing and connecting it to the connector.

In another aspect, the present invention relates to a configurable audio system for fixed or portable operation. The audio system includes a portable housing containing a battery switchably connected to a wiring harness. The audio system also includes a first pair of speakers disposed in the housing and switchably connected to the wiring harness, and a second pair of speakers external to the housing, and connectable to the housing and switchably connectable to the wiring harness. The audio system further includes a first controller having a first audio/video functionality removably mounted in the housing, and a second controller including at least one audio/video function not included in the first controller and removably mountable in the housing. A connector is attached to the wiring harness and is operative to connect to either the first or second controller, whereby the audio system functionality may be altered by mounting either the first or second controller in the housing and connecting it to the connector. The audio system is configurable between fixed operation, by connecting the second pair of speakers to the housing and switchably connecting the second pair of speakers to the wiring harness, and portable operation, by switchably connecting the first pair of speakers to the wiring harness and disconnecting the second pair of speakers from the housing.

In yet another aspect, the present invention relates to a method of altering the audio/video functionality of a portable audio system including a first controller, having a first audio/video functionality, removably mounted in a housing and connected to a wiring harness via a connector. The method includes removing the first controller from the housing and disconnecting the first controller from the wiring harness, removably mounting a second controller having at least one audio/video function not included in the first controller in the housing and connecting the second controller to the wiring harness via the connector, and operating the portable audio system to access the at least one audio/video function not included in the first controller.

DETAILED DESCRIPTION

Figure 1:
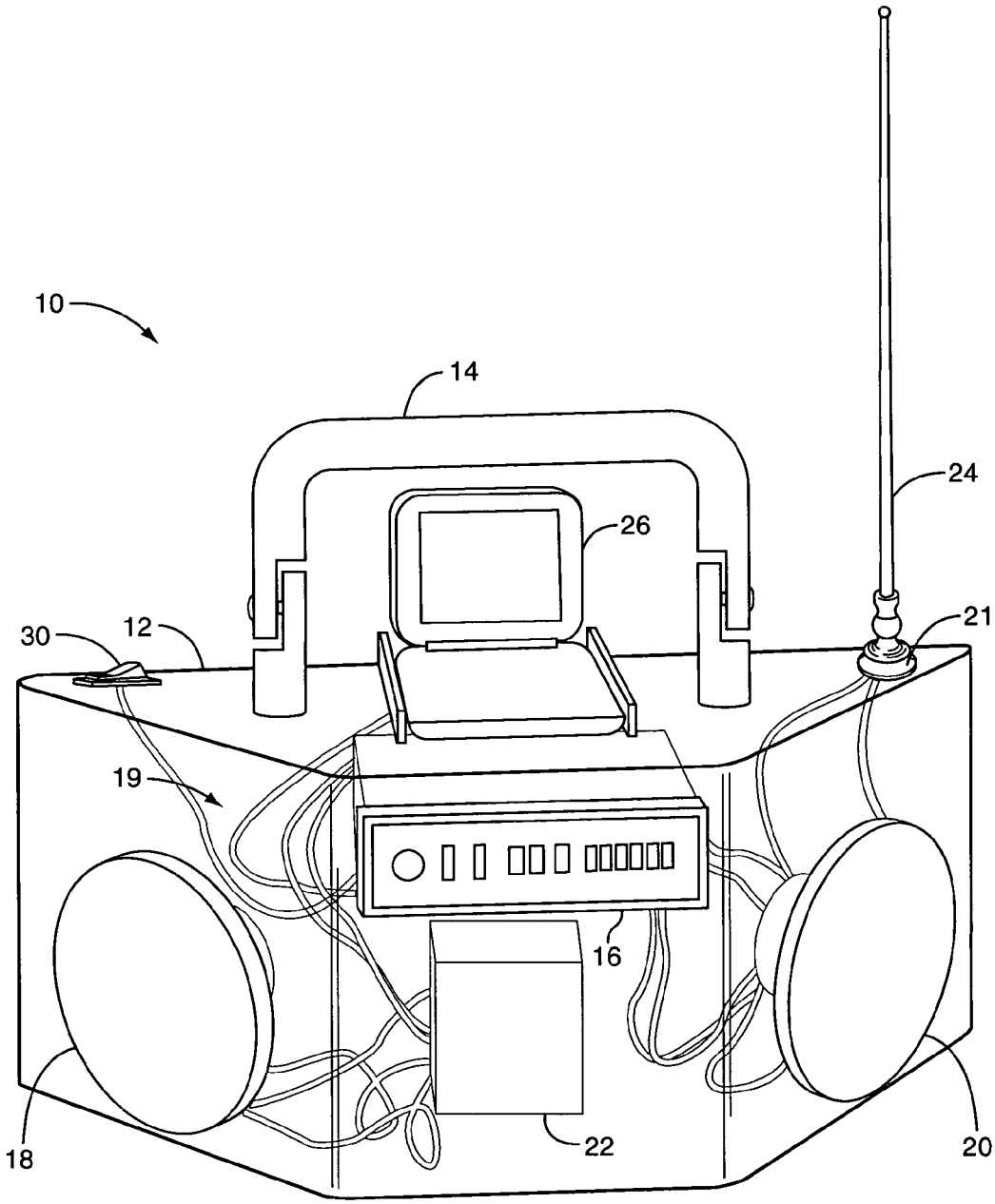
FIG. 1 is a perspective view of a portable audio system.

FIG. 1 depicts a portable audio system according to the present invention, indicated generally by the numeral 10. The portable audio system 10 is characterized by the ability to readily and easily change the audio functionality provided, by changing an audio controller 16. In this sense, the portable audio system 10 of the present invention adopts the component approach of fixed audio systems to the world of portable audio systems.

The portable audio system 10 includes a housing 12, a handle 14, an audio controller 16, a right speaker 18 and left speaker 20, a battery 22, and an antenna connector 21 and antenna 24. The audio components are interconnected via a wiring harness 19. In one embodiment, the portable audio system 10 additionally includes audio/video reproduction functionality, such as by a DVD player 26. In the embodiment depicted in FIG. 1, the housing 12 of the portable audio system 10 is transparent or translucent, and the battery 22, wiring harness 17, and the internal portions of the audio controller 16 and speakers 18, 20, all disposed in the interior of the housing 12, are visible from the exterior.

Figure 2:
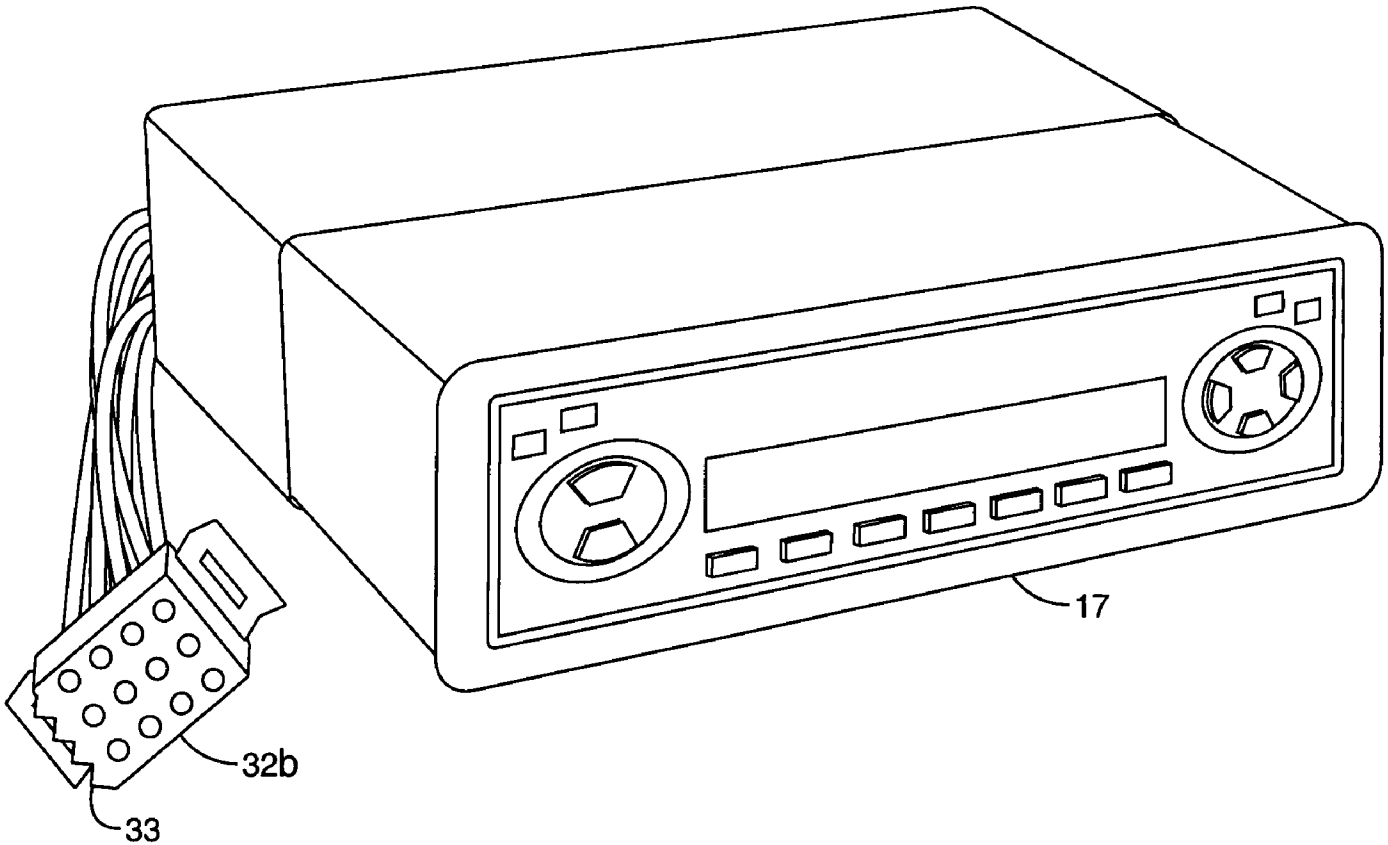
FIG. 2 is a perspective view of an automotive audio controller and connector.

The audio controller 16, another version of which is depicted in FIG. 2 and denoted as 17, is preferably an automotive audio controller. That is, the audio controller 16, 17 is of the type designed to be installed in the dashboard of an automobile. Automotive audio controllers 16, 17 generally conform to one of a handful of physical size specifications and are hence highly interchangeable, and operate on 12 VDC. The automobile audio controllers 16, 17 are designed for operation in the rugged environment of an automobile, and consequently are designed to withstand significant heat, cold, vibration and the like. As well known in the art, automotive audio controllers 16, 17 come in a wide array of styles and price points, and incorporate a large variation of audio functionality. Additionally, many state of the art automotive audio controllers include functionality beyond audio reproduction, including video (for example, a DVD player that outputs the video to a remote screen), satellite navigation features (e.g., GPS receiver and display) and the like. All such controllers are included in the term "automotive audio controller," as used herein.

According to the present invention, as discussed more fully herein, the audio functionality of the portable audio system 10 may be altered or reconfigured at will by the user, by swapping one automotive audio controller 16 for another automotive audio controller 17 having different functionality. The portable audio system 10 according to the present invention includes numerous features that facilitate and ease the task of swapping the automotive audio controllers 16, 17 to achieve a desired set of functionality. Additionally, the portable audio system 10 according to the present invention is useable as both the core of a fixed, or "home" audio system, and a portable, or hand-carried audio system. The configurability of the audio system functionality applies in either case.

Figure 3:
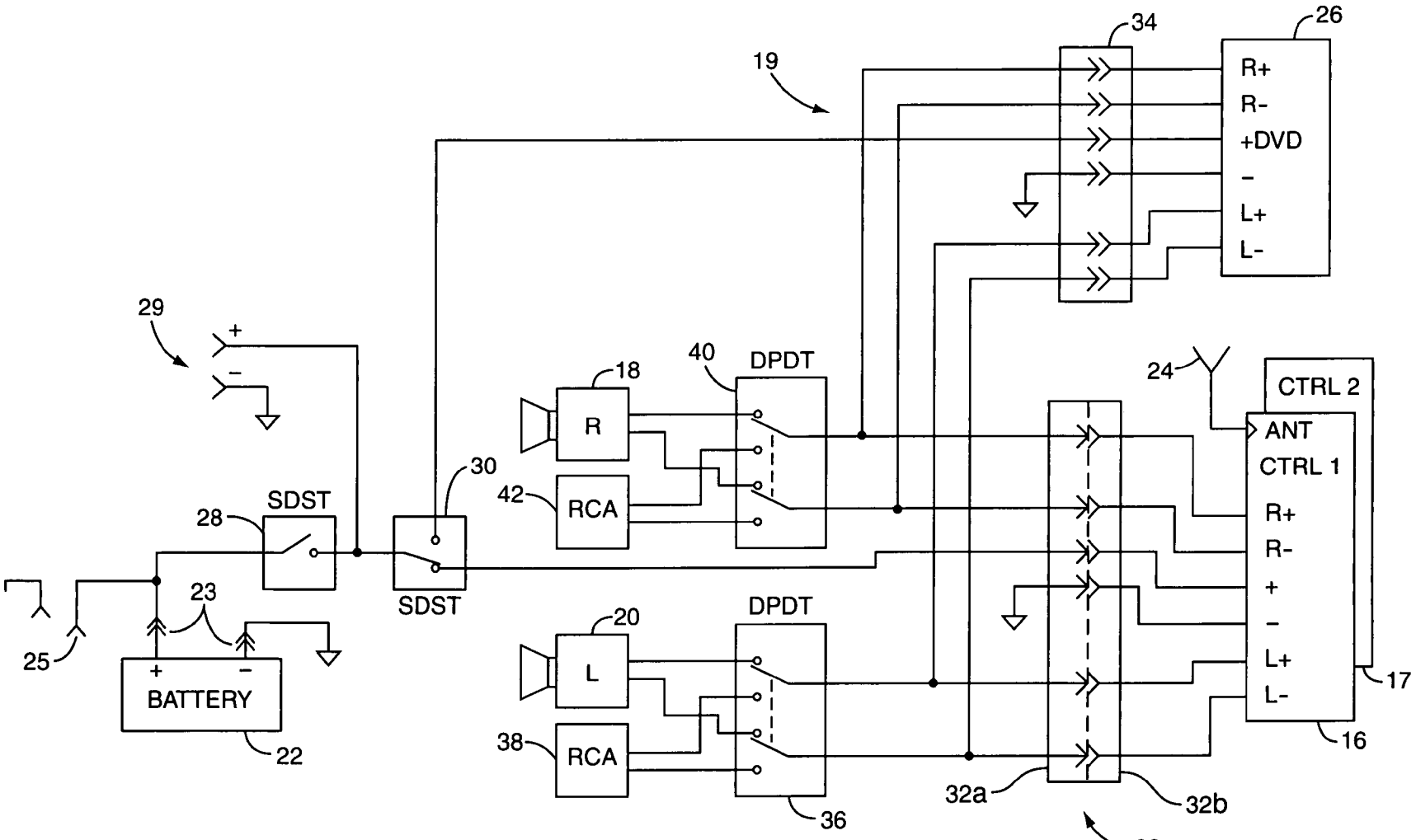
FIG. 3 is an electrical schematic of the portable audio system of FIG. 1.

One embodiment of the portable audio system 10 according to the present invention is depicted in functional electrical schematic form in FIG. 3. The schematic is representative only, and those of skill in the art will readily recognize that the various components may be connected in different ways to achieve the advantages of the inventive portable audio system 10. A wiring harness, indicated generally by the number 19, interconnects the various components of the portable audio system 10. One of two (or more) audio controllers 16, 17 is removably connected to the wiring harness 19 via connector 32.

Connector 32, comprising subpart 32*a* attached to the wiring harness 19 and subpart 32*b* attached to the wiring of the audio controller 16, 17, is a multi-conductor electrical connector, as well known in the art. A representative example of a subpart 32*b* of connector 32 is depicted in FIG. 2. The subparts 32*a* and 32*b* each preferably include a "keyed" feature (with the key of subpart 32*a* being the inverse of the key of subpart 32*b*), such as the non-symmetric surface 33 as indicated in FIG. 2. The keyed feature prevents the subparts 32*a*, 32*b* from being connected together in other than the proper orientation. This feature allows even those not familiar or experienced in electronics to easily swap the audio controllers 16, 17, such as by unplugging the connector subpart 32*b* associated with a first audio controller 16 from the connector subpart 32*a*, and plugging in the connector subpart 32*b* associated with the replacement audio controller 17 to the subpart 32*a*, without danger of an improper connection, which may raise a risk of damage to one or more components, or a hazard to the user.

The signals connected through the connector 32 include positive and negative left speaker and right speaker signals, power, and ground. Note that the schematic of FIG. 3 depicts grounds in the wiring harness 19 using standard ground signal symbols as known to those of skill in the art. In practice, these signals may be physically and/or electrically connected as required or desired. For example, they may all be connected to a common metallic chassis, frame, or other electrically conductive element within the housing 12. Alternatively, in an embodiment such as that depicted in FIG. 1, wherein the housing 12 is a transparent or translucent plastic and hence non-conductive, the ground signals may comprise wires electrically connected together. Additionally, the antenna 24 connects directly to the audio controller 16, 17, if the controller 16, 17 includes a tuner. Alternatively, the antenna 24 may be connected through the connector 32.

The left speaker positive and negative drive signals are connected through the connector 32 to a switch 36, which is preferably a double-pole, double-throw (DPDT) type switch, as well known in the art. Depending on the position of the switch 36, the left speaker signals are directed either to the left speaker 20 disposed in the housing 12 of the portable audio system 10 or to an external speaker jack 38, which is preferably an RCA audio connector jack 38, as well known in the art, but may alternatively comprise any type of electrical connector.

Similarly, the right speaker positive and negative signals are connected through the connector 32 to a double-pole, double-throw (DPDT) switch 40, which directs the signals alternatively to the internal right speaker 18 or an external speaker jack 42. The speakers 18, 20 are preferably automotive speakers, designed to be installed as part of an audio system in an automobile or other vehicle. Like automotive audio controllers 16, 17, automotive speakers 18, 20 are designed to withstand rugged environmental conditions, yet produce high quality audio. Alternatively, the speakers 18, 20 may be of any type, size or style, as required or desired.

Figure 6:
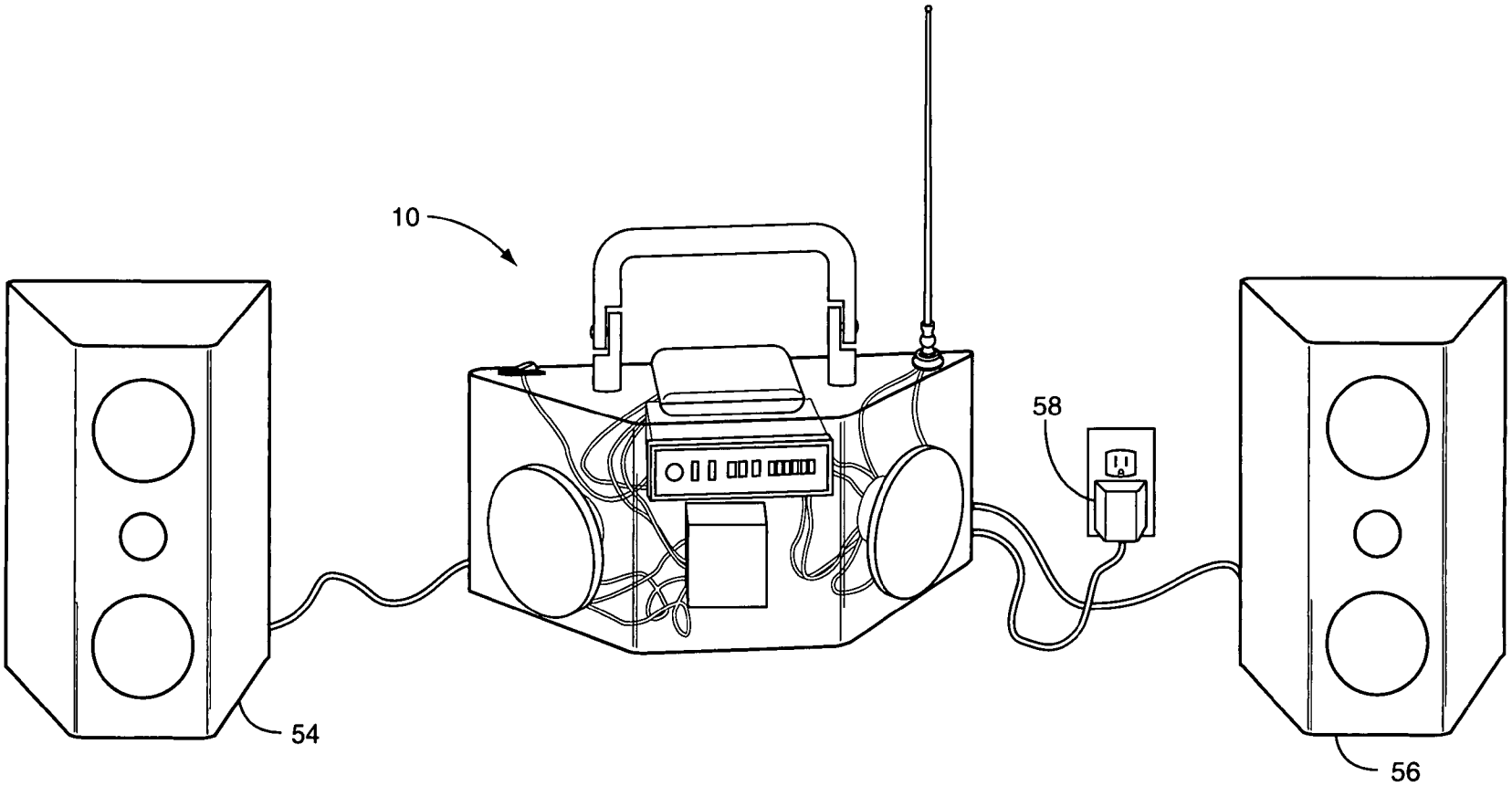
FIG. 6 is a perspective view of the portable audio system of FIG. 1 utilized as the console of a fixed audio system with external speakers and power supply.

In operation, as depicted in FIG. 6, when external speakers 54, 56 are connected to external speaker jacks 38, 42, and the switches 36, 40 actuated to direct the left and right speaker signals to the external jacks 38, 42, the portable audio system 10 of the present invention operates as the central console of a fixed or "home" audio system. In one embodiment, the external speaker outputs may be amplified prior to connection to external speaker jacks 38, 42, as required or desired to drive external speakers 54, 56.

Referring again to FIG. 3, in one embodiment of the present invention, the left and right speaker signals are additionally connected, through connector 34 (similar in essential respects to connector 32) to a video player, such as a DVD player 26 mounted on or integrated into the portable audio system 10 (see FIG. 1).

Power for portable operation of the portable audio system 10 is supplied by a battery 22. The battery 22 is preferably a rechargeable, sealed gel battery, which preferably produces a 12 VDC output. The battery is connected to the wiring harness 19 by electrical battery contacts 23. A second set of electrical battery contacts 25 are provided. This allows two batteries 22 to be disposed within the portable audio system 10, and one plugged in when the other discharges, for example to allow for watching a full-length movie on the DVD player 26 (discussed below). The positive voltage output of the battery 22 is connected to an isolation switch 28. Switch 28 is preferably a single-pole, single-throw (SPST) switch, and is operative to electrically remove the battery 22 from the wiring harness 19. That is, the battery 22 is switchably connected to the wiring harness 19. The ability to electrically isolate the battery 22 from the wiring harness 19 preserves battery life by allowing the user to disconnect the battery 22 during periods of non-use. This prevents parasitic drain of the charge in the battery 22. Additionally, the battery 22 is disconnected from the wiring harness 19 by the switch 28 when an external power supply 58 (see FIG. 6) is connected to the wiring harness 19, via external power jacks 29. This allows for use of the portable audio system 10 as a fixed or "home" audio system console, without draining the battery 22. External power jacks 29 may be of any appropriate type, as known in the art.

The positive power signal is switched between an audio controller 16, 17 and a video player 26 by switch 30. Switch 30 is preferably a single-pole, double-throw (SPDT) type switch. Those of skill in the art will note that due to switch 30, only one of an audio controller 16, 17 and a video player 26 may be operative at any given time. Thus, the electrical connection of the left and right speaker signals from the two sources 16/17, 26 prior to switches 36, 40 do not risk any interference.

Figure 4:
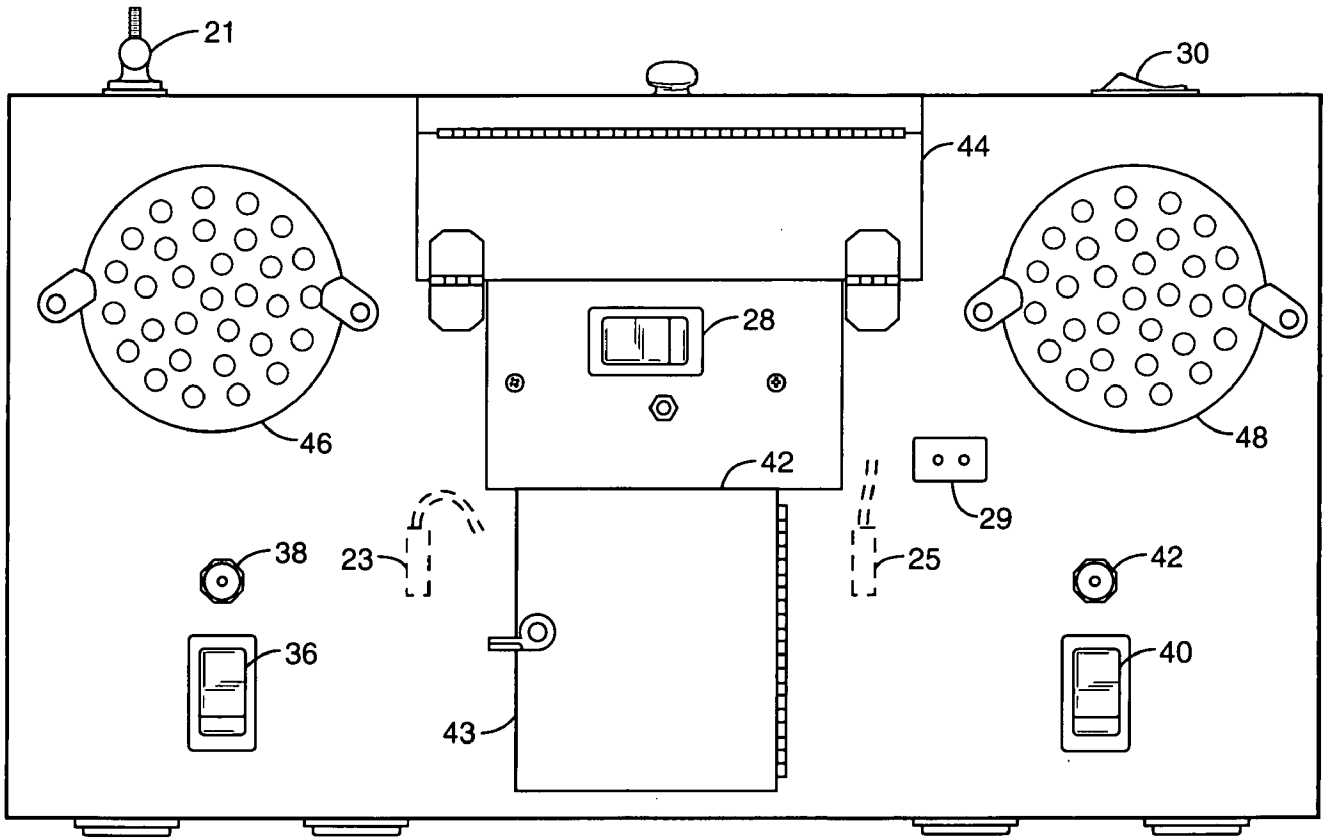
FIG. 4 is a rear view of the portable audio system of FIG. 1.

FIG. 4 depicts the back panel of the portable audio system 10 of FIG. 1 (although the back panel may be transparent or translucent, internal components, other than battery electrical connectors 23, 25 are not depicted in the drawing of FIG. 4 for clarity). FIG. 4 depicts left and right external speaker jacks 38 and 42, and their associated internal/external speaker switches 36, 40, respectively. Also disposed in the back panel is the external power jack 29. Between the speaker switches 36 and 40 is an access door 43, which allows access to the interior of the housing 12, such as to adjust wiring connections, replace the battery 22, and the like. To facilitate assembly and advanced troubleshooting and repair, a removable panel 45 is provided above the access door 43. Panel 45 is secured by fasteners, and is not normally removed by a user. Additionally, removable inserts 46 and 48 provide both air flow for thermal cooling and further access to the upper regions of the interior of the housing 12, as required during assembly to connect the wiring harness 19 to various components. Within the removable panel 45, above the access door 43, is the power isolation switch 28. An access door 44 may optionally be provided to access a storage chamber defined by walls (not shown) interior to the housing 12, such as for the storage of CDs, DVDs and the like. Finally, FIG. 4 depicts the power direction switch 30 and the antenna mount 21.

Figure 5A:
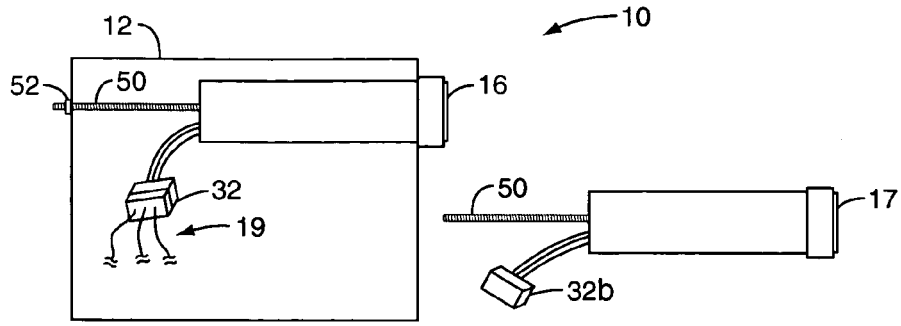
FIGS. 5A-5D are schematic diagrams depicting changing the audio controller of a portable audio system.

FIGS. 5A through 5D depict, in functional schematic form, one embodiment of a method of changing the functionality of the portable audio system 10 by swapping audio controllers 16, 17. FIG. 5A depicts the housing 12 of the portable audio system 10. Disposed within the housing 12 is a first audio controller 16. The audio controller 16 electrical signals are connected via connector 32 to the wiring harness 19, partially displayed. In one embodiment, a threaded rod 50 extends from a tapped hole (not shown) in the rear face of the audio controller 16, and protrudes slightly from the back face of the housing 12. A nut 52 secures the threaded rod 50 and holds the audio controller 16 firmly in the housing 12. A second audio controller 17, having at least one audio function different than the audio controller 16, also having a threaded rod 50 connected thereto and wiring terminating in connector subunit 32*b*, is disposed separately from the portable audio system 10.

Figure 5B:
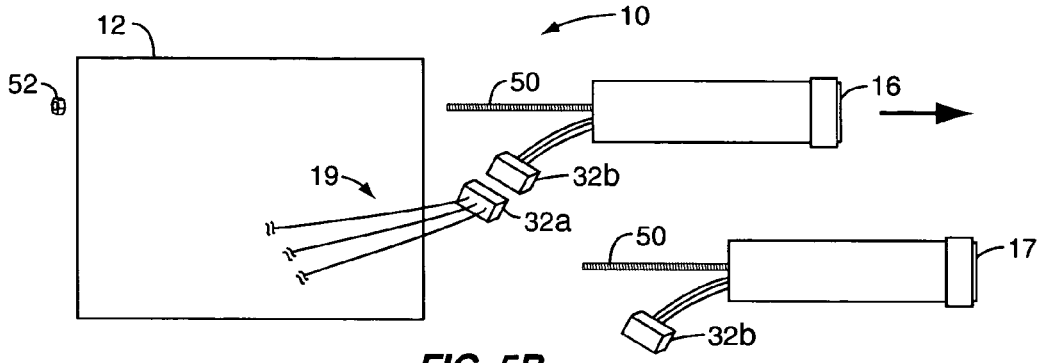

In FIG. 5B, the first audio controller 16 is removed from the housing 12 by removing the nut 52 from the threaded rod 50, partially extracting the audio controller 16 from the housing 12 to access the connector 32, and separating the subunits 32*a* and 32*b* of the connector 32. If the antenna 24 (not shown) is connected to the first audio controller 16, it is disconnected. The first audio controller 16 is then fully removed from the housing 12.

Figure 5C:
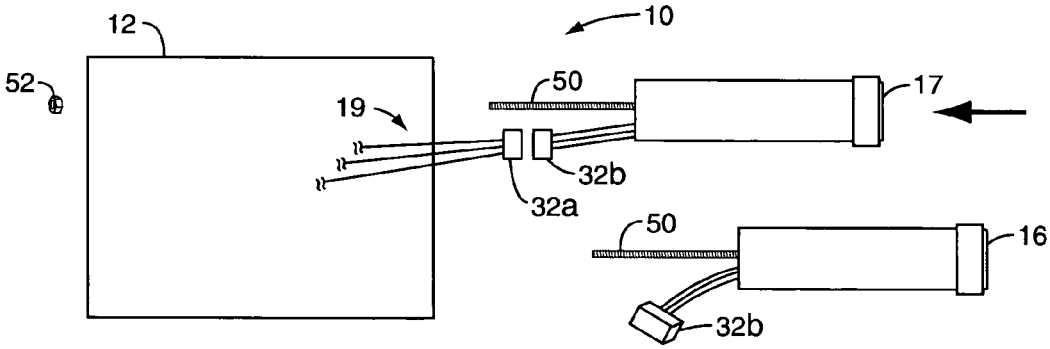

FIG. 5C depicts the second audio controller 17 partially inserted into the housing 12, where the subunits 32*a* and 32*b* of connector 32 are connected together, electrically connecting the second audio controller 17 to the wiring harness 19. If the second audio controller 17 includes a tuner, the antenna 24 (not shown) may be connected to the controller 17.

Figure 5D:
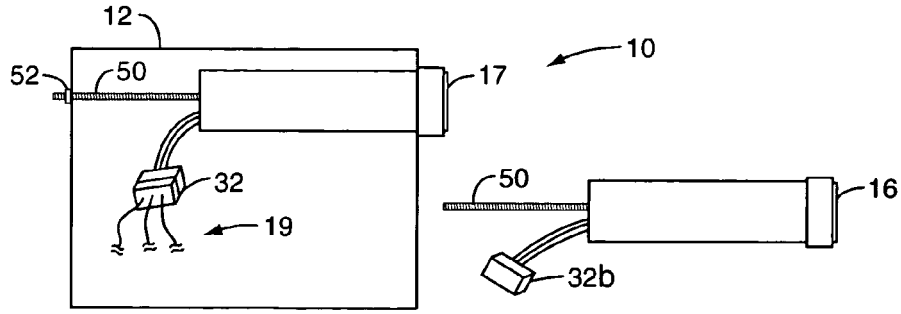

FIG. 5D depicts the second audio controller 17 fully installed in the housing 12 of the portable audio system 10. The threaded rod 50 protrudes through the back of the housing 12, and is secured with nut 52, thus firmly securing the second audio controller 17 in the housing 12. The second audio controller 17 is connected to the wiring harness 19 via connector 32, and configures the portable audio system 10 to provide audio functionality different in at least one function than that when the first audio controller 16 was installed.

As will be readily apparent to one of skill in the art, the threaded rod 50 and nut 52 of the embodiment depicted in FIGS. 5A through 5D are illustrative mounting systems only, and the present invention is not limited thereby. The first and second audio controllers 16, 17 may be physically secured within the housing 12 according to a broad variety of mechanical connectors, couplers and mounting systems, all of which would fall within the scope of the present invention. Additionally, only two audio controllers 16, 17 are depicted to illustrate the process and ease of switching audio controllers 16, 17. It is readily apparent to those of skill in the art that the process may be repeated for a plurality of audio controllers 16, 17, providing a broad array of audio functionality and configuration possibilities for the portable audio system 10.

FIG. 6 depicts the portable audio system 10 of the present invention arranged and configured as a home audio system. An external power supply 58, operative to step down and rectify household A/C current to, preferably, 12 VDC, is plugged into a common electrical power receptacle, and connected to the external power jack 29 on the back panel (see FIGS. 3, 4). Power switch 28 (FIGS. 3, 4) is actuated to switchably disconnect the battery 22 from the wiring harness 19. External speakers 54, 56 are connected to external speaker jacks 38, 42, respectively, and internal speakers 20, 18 are switchably disconnected from the wiring harness 19 by switches 36, 40 (FIGS. 3, 4). The portable audio system 10 may optionally be mounted on a shelf, stand, or similar placement as required or desired. In this manner, the portable audio system 10 doubles as a home or fixed audio system. Additionally, the benefit of reconfigurability via swapping the controllers 16, 17 is retained in the home audio system configuration.

Figure 7:
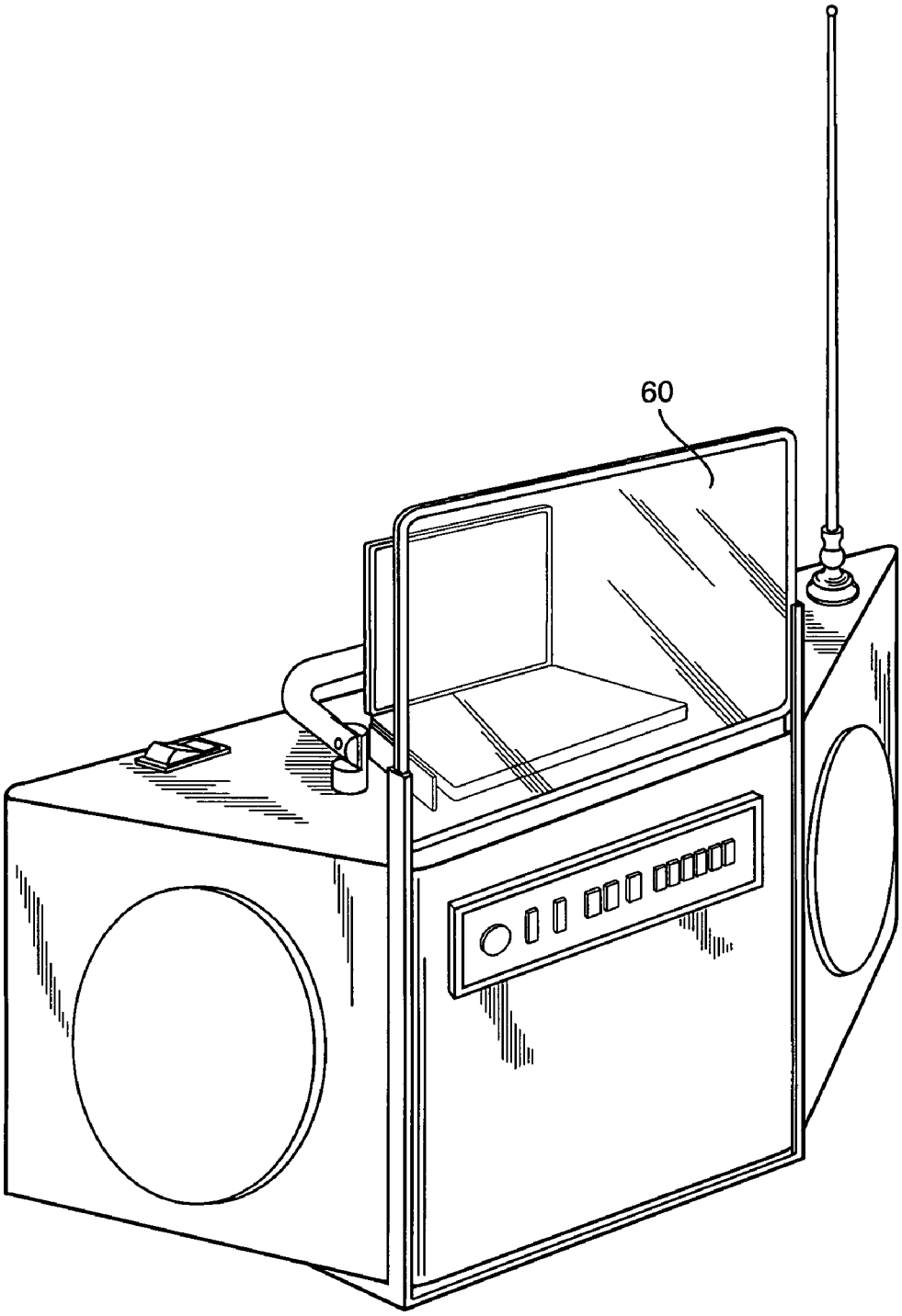
FIG. 7 is a perspective view of the portable audio system of FIG. 1, configured to display video and having a magnification screen attached.

As discussed above, in one embodiment, depicted in FIG. 7, the portable audio system 10 of the present invention includes a DVD player 26 mounted to the upper surface thereof (see FIGS. 1, 6). For portability, the DVD player 26 necessarily has a relative small viewing screen (as compared to common video equipment such as televisions and computer screens). To enhance the DVD viewing experience, a magnification screen 60 may be positioned between the DVD viewing screen and the user. The magnification screen 60 is commercially available, and its operation and use is well known to those of skill in the art.

As used herein, the term "portable audio system" refers to a battery-operated audio system that can be carried by a user, and produces audio output from at least one audio source. Audio system mounted in automobiles and other vehicles are not "portable audio systems" as the term is used herein. As used herein, the term "fixed" audio system refers to an audio system that is infrequently, if ever, moved. A fixed audio system as the term is used herein is often referred to in the art as a home audio system. As used herein, the terms "switchably connected" or "switchably connectable" refer to signals that are selectively electrically connected, or electrically isolated from, an entity (such as a component or wiring harness) via actuation of a switch. As used herein, a "wiring harness" is the set of wires operatively and electrically interconnecting the various system components, whether or not the wires are physically grouped or assembled together.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A portable audio system having alterable functionality, comprising:

a portable, transparent or translucent housing containing a battery connected to a wiring harness, the wiring harness at least partially visible through the housing;

a first controller having a first audio/video functionality, removably mounted in said housing;

a second controller including at least one audio/video function not included in said first controller and removably mountable in said housing; and a connector attached to said wiring harness and operative to connect to either said first or second controller, whereby said audio system functionality may be altered by mounting either said first or second controller in said housing and connecting it to said connector.

2. The portable audio system of claim 1 further comprising at least one speaker disposed in said housing and connected to said wiring harness.

3. The portable audio system of claim 1 further comprising an external power connector and a switch operative to exclusively connect one of said battery or an external power supply to said wiring harness.

4. The portable audio system of claim 1 further comprising at least one external speaker connector and a switch operative to exclusively connect one of said at least one speaker disposed in said housing, or at least one external speaker, to said wiring harness.

5. The portable audio system of claim 1 wherein said first and second controllers are automotive audio controllers.

6. The portable audio system of claim 2 wherein said at least one speaker is an automotive audio speaker.

7. The portable audio system of claim 1 wherein said connector is a quick-detach type connector.

8. The portable audio system of claim 1 further comprising a video player mounted to said housing and switchably connected to said wiring harness.

9. The portable audio system of claim 8 further comprising a power direction switch operative to switch power to either said first or second controller or said video player.

10. The portable audio system of claim 1 wherein said wiring harness is visible through said housing.

11. A configurable audio system for fixed or portable operation, comprising:

a portable, transparent or translucent housing containing a battery switchably connected to a wiring harness, the wiring harness at least partially visible through the housing;

a first pair of speakers disposed in said housing and switchably connected to said wiring harness;

a second pair of speakers external to said housing, connectable to said housing and switchably connectable to said wiring harness;

a first controller, having a first audio/video functionality, removably mounted in said housing;

a second controller, including at least one audio/video function not included in said first controller, and removably mountable in said housing; and a connector attached to said wiring harness and operative to connect to ether said first or second controller, whereby said audio system functionality may be altered by mounting either said first or second controller in said housing and connecting it to said connector;

whereby said audio system is configurable between fixed operation by connecting said second pair of speakers to said housing and switchably connecting said second pair of speakers to said wiring harness, and portable operation by switchably connecting said first pair of speakers to said wiring harness and disconnecting second pair of speakers from said housing.

12. The audio system of claim 11 further comprising an external power supply connectable to said housing and switchably connectable to said wiring harness.

13. The audio system of claim 11 further comprising a video player mounted on said housing and switchably connected to said wiring harness.

14. The audio system of claim 11 further comprising a power direction switch operative to switch power to either said first or second controller or said video player.

15. A method of altering the audio/video functionality of a portable audio system including a first controller, having a first audio/video functionality, removably mounted in a housing and connected to a wiring harness via a connector, comprising:

removing said first controller from said housing and disconnecting said first controller from said wiring harness;

removably mounting a second controller having at least one audio/video function not included in said first controller in said housing and connecting said second controller to said wiring harness via said connector; and operating said portable audio system to access said at least one audio/video function not included in said first controller.

16. The method of claim 15 wherein said first and second controllers are automotive audio controllers.

17. The method of claim 15 wherein said connector is a quick-detach type connector.

18. The method of claim 15 wherein said connector is keyed to preclude improper connection.

* * * * *